US008951070B1

(12) United States Patent
Goodwin

(10) Patent No.: US 8,951,070 B1
(45) Date of Patent: Feb. 10, 2015

(54) SATA AND SAS PLUG CONNECTOR

(71) Applicant: Paul Goodwin, The Hills, TX (US)

(72) Inventor: Paul Goodwin, The Hills, TX (US)

( * ) Notice: Subject to any disclaimer, the term of this patent is extended or adjusted under 35 U.S.C. 154(b) by 0 days.

(21) Appl. No.: 14/053,028

(22) Filed: Oct. 14, 2013

(51) Int. Cl.
*H01R 24/00* (2011.01)
*H01R 12/72* (2011.01)

(52) U.S. Cl.
CPC ..... *H01R 12/721* (2013.01)
USPC ..... 439/660

(58) Field of Classification Search
CPC ..... H01R 23/7023; H01R 31/00
USPC ..... 439/660, 723, 721
See application file for complete search history.

(56) References Cited

U.S. PATENT DOCUMENTS

| | | | | |
|---|---|---|---|---|
| 2009/0130878 | A1* | 5/2009 | Xu et al. | 439/157 |
| 2010/0099307 | A1* | 4/2010 | Zhang et al. | 439/660 |
| 2011/0263162 | A1* | 10/2011 | Zhu | 439/660 |
| 2012/0077385 | A1* | 3/2012 | Qiao | 439/628 |
| 2012/0108109 | A1* | 5/2012 | Zhang et al. | 439/629 |
| 2014/0106590 | A1* | 4/2014 | Wu et al. | 439/284 |

OTHER PUBLICATIONS

Serial ATA International Organization: Serial ATA Revision 3.0, Jun. 2, 2009, Gold Revision.
SFF Committee, SFF-8680 Specification for Serial Attachment 12 Gb/s 2x Unshielded Connector, Rev. 1.5, Jun. 15, 2012.

* cited by examiner

*Primary Examiner* — Phuongchi T Nguyen
(74) *Attorney, Agent, or Firm* — Denko Coburn Lauff LLP

(57) ABSTRACT

A high speed, high reliability connector that may be employed with standard Serial ATA (SATA) or Serial Attached SCSI (SAS) compliant receptacle connectors. The present invention reduces impedance discontinuity by reducing the interconnection length and cross-planar transit found in typical SATA and SAS compliant connectors.

12 Claims, 23 Drawing Sheets

SATA AND SAS PLUG CONNECTOR

TECHNICAL FIELD

The present invention relates to electrical interconnect devices and, more particularly, to an improved connector compliant with a SATA standard.

BACKGROUND OF THE INVENTION

Electrical connectors are essential to any electrical or electronic system. Designers of electronic component ranging from portable consumer electronics to massive computer platforms have constantly strived to find the highest performing, lowest cost connectors. The applications may vary, from plugging modules into a back plane to plugging a set of headphones into a portable media player, but the goal is the same, to provide the best connection at the lowest cost.

Recent trends in the industry have tended to reduce the number of interconnect pins on the integrated circuits employed in systems. One method of reducing the number of pins is to replace parallel signal interfaces with high speed serial channels that transfer data with equal or greater bandwidth using fewer signals pins. However, to achieve the same bandwidth as a parallel interface, the signals on a serial interface need to run at faster speed. For example, when a 16-bit parallel interface, consisting of 16 individual data channels, is replaced by a single serial channel, the serial channel will have to operate at 16× the speed of one of the parallel channels.

Consequently, to achieve the speeds required, the serial lines may have to employ differential signaling techniques. Differential signaling techniques allow signals to run at significantly higher speeds than do single-ended techniques. This results in an overall reduction of the number of connections required to provide the bandwidth necessary for the interface.

The adoption of high-speed serial interconnects has resulted in significant increases in interface speeds reaching in excess of 10 Gigabits per second (Gb/s). The increase in data rates has, however, introduced a new set of problems many of which relate to signal integrity.

One of the most important factors in the design of a system interconnect is what is known as signal integrity. Signal integrity refers to the quality of the signal at the receiving end of the network and, therefore, it determines the maximum speed at which the channel can transfer data. Example factors that affect the signal integrity of an interconnect are: component variation, material variations, power distribution, signal crosstalk, PCB layout, PCB construction and impedance discontinuities. Most of these factors can be addressed with good design and manufacturing techniques for given components or materials. However, the ubiquity of signal connectors has made impedance discontinuities an issue that has received considerable industry attention.

There are 3 primary places in an interconnect where impedance discontinuities arise. These are: (i) the module to connector connection on the device; (ii) connector to receptacle connector contact; and (iii) the module to connector connection on the host side.

A common impedance discontinuity arises when the cross-section of the conducting element changes. As those of skill will appreciate, when a conducting element presents two cross sections, the first cross-section of the conducting element has a first characteristic impedance while the second cross-section of the conducting element has a second and typically different characteristic impedance.

This creates two physically dissimilar transmission lines and causes distortion in the fields and a small mismatch, even for lines of like characteristic impedance (Zo).

Another impedance discontinuity arises where connectors do not have a "through" characteristic impedance that matches the transmission line. Not only may there be geometric discontinuities, the length of the different sections with different characteristic impedances may create significant signal reflection which adversely affects on signal integrity. As those of skill will recognize, a section of mismatched line in an otherwise matched system changes the impedance looking into the mismatched section.

From an impedance perspective, connectors are complex. Their individual components can each contribute to make uncertain what might be thought an easily determined impedance value. The leading edge of a signal propagating down the transmission line model of a connector acts like a wave. When a wave hits an impedance discontinuity, a portion of the wave is going to continue propagating while a portion is reflected back toward the source. The percentage of the wave reflected is related to the difference in characteristic impedance of two (2) segments. The greater the discontinuity, the greater the reflection. In short, impedance deviations cause signal reflections and impair transmission characteristics. Consequently, what is needed is a new design compliant with existing standards but which presents a cleaner impedance path to signal flow.

SUMMARY OF THE INVENTION

The present invention provides a high speed, high reliability connector that may be employed with standard Serial ATA (SATA) or Serial Attached SCSI (SAS) compliant receptacle connectors. The present invention reduces impedance discontinuity by reducing the interconnection length and cross-planar transit found in typical SATA and SAS compliant connectors.

In a preferred embodiment implemented in accordance with the present invention, a high signal integrity connector presents an extended length PCB shaped on a connector-replacing end to support electrical contacts disposed on a first side of the PCB in the same position they would occupy if the subject connector was a conventional SATA connector. Optionally, a connector in accordance with an embodiment supports a set of electrical contacts on the second side of the PCB. Preferably, a plastic shroud the same size and shape as a standard connector surrounds the PCB so that when the shroud is mounted, the combination is compatible with an industry standard receptacle for the device.

DETAILED DESCRIPTION OF PREFERRED EMBODIMENT

Figure 1:
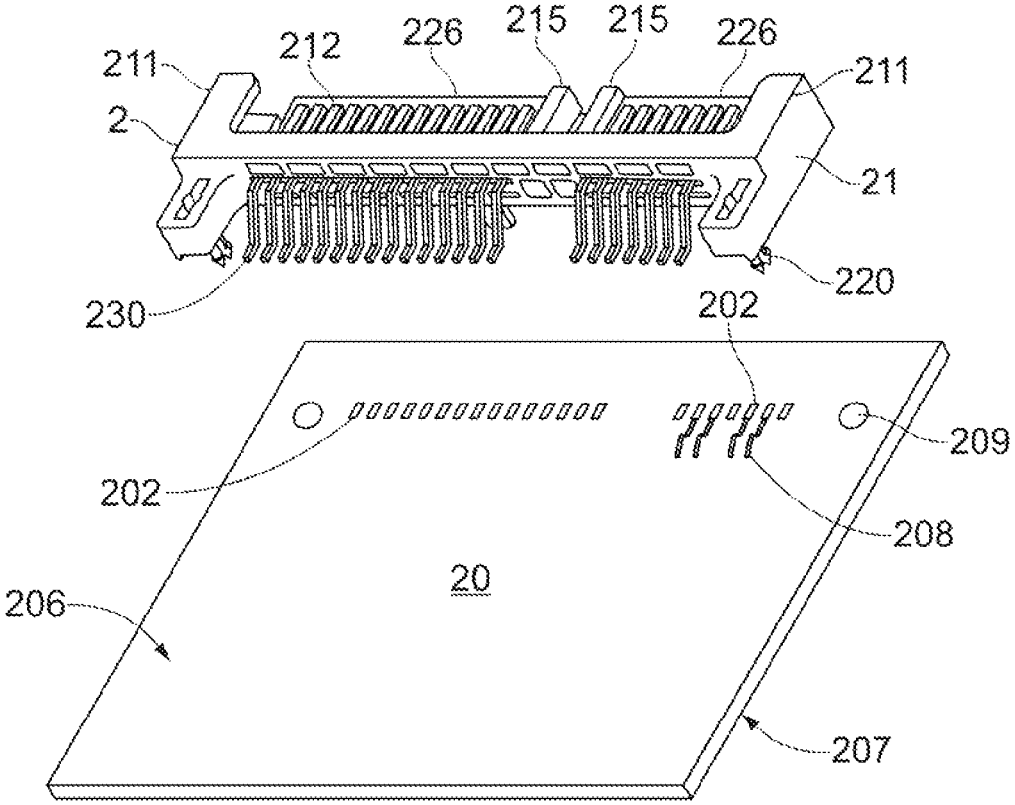
FIG. 1 depicts an isometric view of a conventional SATA plug connector.

FIG. 1 depicts an exploded isometric view of a conventional SATA compliant plug connector 2. Conventional SATA compliant plug connector 2 is comprised of a connector housing 21 that is further comprised of several features that conform to the industry standard SATA interconnect. There are guide posts 211 that align conventional SATA compliant plug connector 2 with a SATA compliant receptacle connector and facilitate blind mating. Between guide posts 211 one or more connector blades 226 support the electrical contacts 212 of conventional SATA compliant plug connector 2. Connector blades 226 are disposed relative to keys 215 in a unique location. Additional applications may use the same basic connector structure and are made unique by having a different key 215 locations. The guide posts 211, connector blades 226, key 215 locations and the number of and location of the contacts 212 are defined by the Serial ATA International Organization (SATA-IO). For example, the dimensional requirements for a SATA compliant connector such as blade extension, width, thickness and spacing as well as key configuration are stated in what is identified as the SATA Specification below as identified in detail with reference to FIG. 2.

The other side of SATA compliant plug connector 2 is not standard and varies by manufacturer, mounting style and orientation. However, the same basic elements exist across all manufacturers. This particular connector 2 as depicted provides a mechanical attachment with boardlocks 220 that are inserted into through holes 209 in PCB 20 which has a first side 206 and a second side 207. Conventional SATA compliant plug connector 2 is attached to a module PCB 20 and contacts 212 of the SATA compliant plug connector 2 are connected with pads 202 on module 20.

Figure 2:
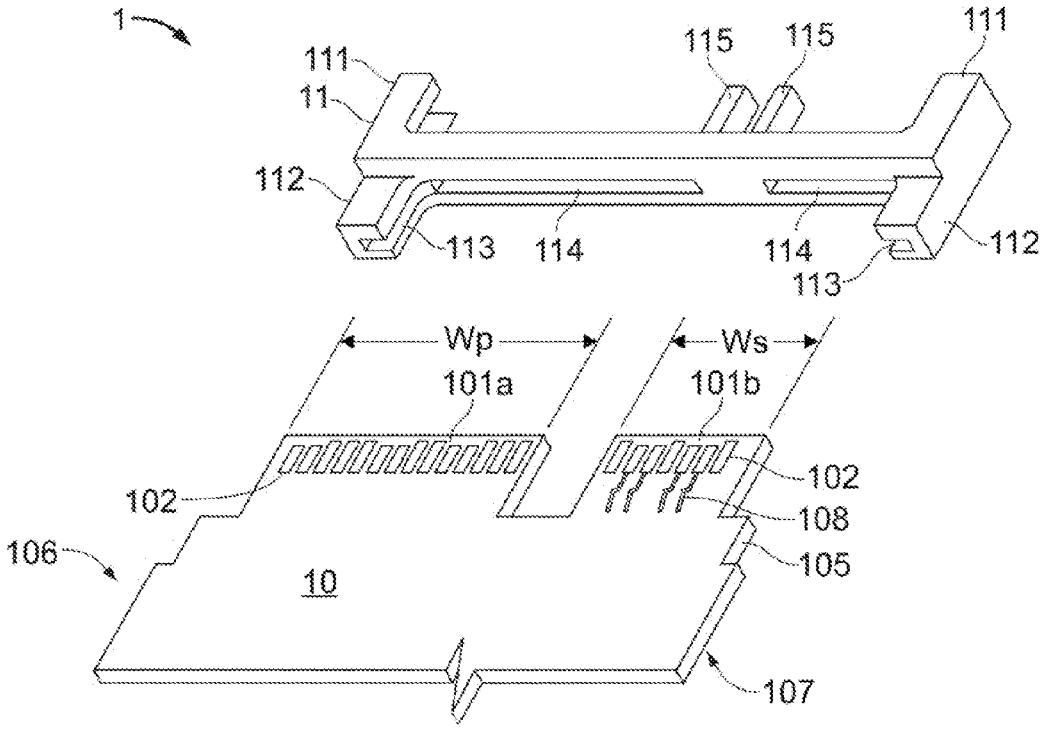
FIG. 2 depicts an exploded isometric view of an embodiment of the present invention.

FIG. 2 depicts an exploded isometric view of an embodiment 1 of the present invention. Printed circuit board 10 or as it is commonly referred to in the industry as PCB 10 is shown along with connector housing 11 coupled with PCB 10. PCB 10 has a top first surface 106 and a second bottom surface 107. There are two tabs 101*a* and 101*b* formed on one end of PCB 10. The size, shape, thickness and relative position of tabs 101*a* and 101*b* approximates the size, shape, thickness and relative position of connector blades such as blades 226 typically found in a conventional SATA compliant plug connector as depicted in FIG. 1. Tab 101*a* supplants the power tab and tab 101*b* supplants the signal tab of a conventional SATA compliant plug connector. Tab 101*a* has a width of $W_P$ as shown while tab 101*b* has a width of $W_S$ as indicated in FIG. 2. In a preferred embodiment, $W_P$ is substantially the same dimension as is specified for the width of a power blade in a SATA connector that is compliant with a SATA specification. One commonly referenced SATA specification is the Serial ATA International Organization's "Serial ATA Revision 3.0" specification dated Jun. 2, 2009 also known as the "Gold Revision" which is hereby incorporated by reference (the "SATA Specification"). Starting at page 79 in the SATA Specification, the dimensional requirements for a SATA compliant connector are stated and when reference is herein made to a dimension in comparison to a conventional SATA compliant connector, reference is being made to a SATA specification that states the subject dimension and such a SATA specification is the SATA Specification identified above.

In a preferred embodiment, $W_S$, as indicated in FIG. 2, is approximately the same dimension as is specified for the width shown for a signal blade in the SATA Specification.

Disposed on the first top surface 106 of tabs 101 is etch 108 leading up to and connected to a conductive pad 102 disposed on the first top surface 106. The conductive pads 102 are of a length and width that substantially conforms to the size of contacts 212 in a conventional SATA compliant plug connector 2. The number of contact pads 102 and the relative position of the pads substantially conform to the number and position of contacts 212 of a SATA compliant plug connector 2.

Connector housing 11 is a mechanical component devised to adapt tabs 101*a* and 101*b* of PCB 10 into a plug connector assembly module 1 that is compatible with an industry standard SATA compliant receptacle connector. To accomplish this, connector housing 11 conforms to the mechanical requirements of a SATA plug connector housing as defined by the SATAIO. Housing 11 provides the features of connector blades 226 (as shown in earlier FIG. 1) that are impractical to build on tabs 101 of PCB 10. For example, key 215 structures on connector blades 226 of a SATA compliant plug connector 2 are such a feature and in the embodiment shown in FIG. 2 such key structures are provided by housing 11. Because keys 115 of the depicted embodiment are significantly thicker than the planar PCB 10, they would have to be added in an intermediary step if not incorporated into connector housing 11 and thus the depicted configuration has some advantages although those of skill will appreciate that keys 115 need not be fabricated with housing 11 as one integrated piece.

Contacts 102 are disposed on tabs 101*a* and 101*b* which are disposed on an end of PCB 10. A variety of methods can be used to configure tabs 101*a* and 101*b* on the end of PCB 10 as those of skill will recognize after appreciating this disclosure. Routing, for example, is a well known method readily useful for such configuration. A variety of cutting methods may also be employed for such operation.

Tabs 101*a* and 101*b* are configured to pass through slots 114 of housing 11. Slots 114 are disposed so that when tabs 101*a* and 101*b* extend through connector housing 11 they are positioned so that they, along with keys 115, create a structure that presents a configuration that meets the basic requirements of the SATA standards as they relate to the connector blades 226 of the conventional SATA compliant plug connector 2. Module side card guides 112 have slots 113 that fit over notches 105 in PCB 10 to provide support.

Figure 3:
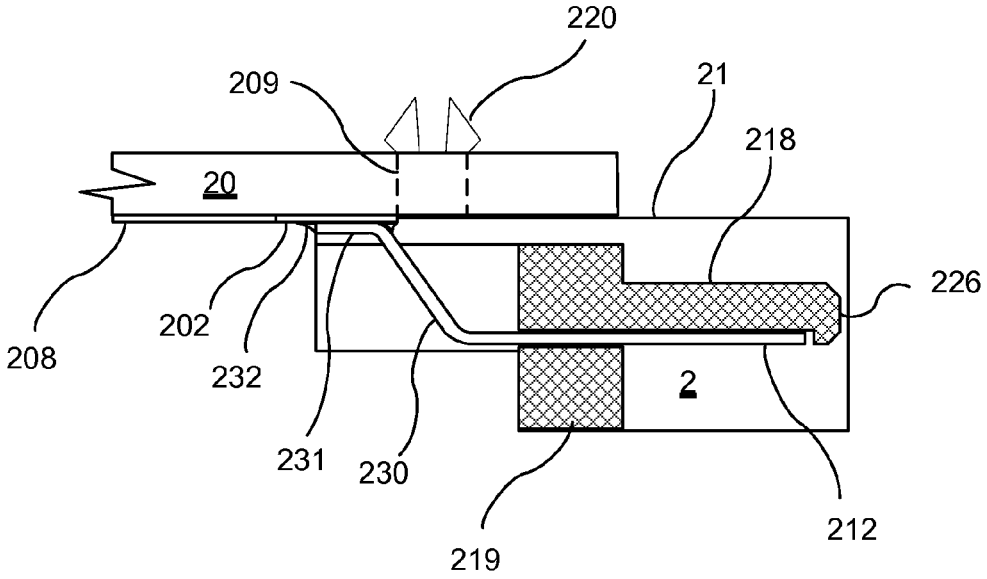
FIG. 3 depicts the cross section of a conventional SATA plug connector.

FIG. 3 depicts a cross section of a conventional SATA complaint plug connector 2 mounted on PCB 20. Shown are connector housing 21 that forms the shroud and member 219 that forms a support structure for connecting blade 218. The conventional SATA plug connector 2 is placed on PCB 20 and is mechanically held in place with retention clips 220 that are inserted in holes 209 in PCB 20. Conventional SATA plug connector 2 typically has twenty-two (22) contacts 212. One skilled in the art will appreciate that this connector 2 may support a wide range of number of contacts 212. The exemplary contact 230 depicted here is shaped such that when inserted into housing 21 through the supporting member 219, conducting surface 212 is created on connecting blade 218 as well at its other end, a surface mount lead 231 for an electrical connection to surface mount pad 202 on PCB 20 to which it is attached with solder 232.

Recalling the previous discussion concerning impedance discontinuities, the principles of which are well known to those of skill in the art, the electrical path that is created with the standard SATA connector assembly can be followed from trace 208 on PCB 20 to surface mount pad 202 to surface mount trace (SMT) lead 231 (through solder bond 232) to contact 230 and then through connector housing 21 and support 219 to conducting surface 212. One skilled in the art will appreciate that there are several points in this electrical path where the signal must transit the several planes and various topologies presented by the signal circuit pathway and that, consequently, the presented impedance discontinuities are greater and more numerous than desired.

Figure 4:
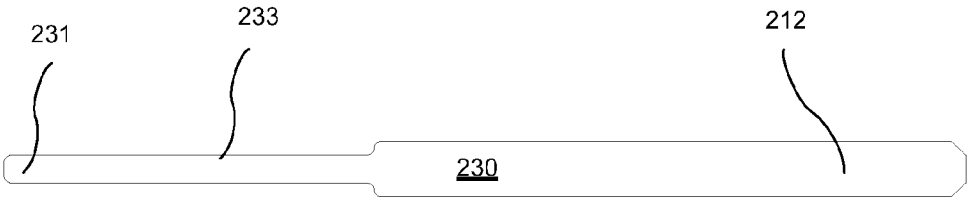
FIG. 4 depicts a pre-formed contact element of a conventional SATA plug connector.

For example, an impedance discontinuity arises where signal trace 208 meets SMT pad 202 on PCB 20. Another impedance discontinuity arises between SMT pad 202 and connector pin 231 as a result of the solder bond 232 and the change in geometry between the etched signal trace 208 and connector lead 231. A third impedance discontinuity occurs when contact 230 changes its cross-section from a wire 233 to blade 212 as shown in FIG. 4. The preceding description describes signals that originate on the module 20 of a system that employs the conventional SATA plug connector 2. One skilled in the art will recognize that signals originating on the host side of the interconnect will see the same impedance discontinuities in the reverse order.

FIG. 4 shows a view of a typical pre-formed connector contact 230. Here the cross-section change is visible from wire region 233 to blade region 212. The change in cross-section is necessary because the width specified for the contact surface of blade 212 of contact 230 and the contact to contact spacing does not leave sufficient spacing between the leads at the SMT end to form a reliable solder joint 232 without solder bridging between adjacent contacts.

Figure 5:
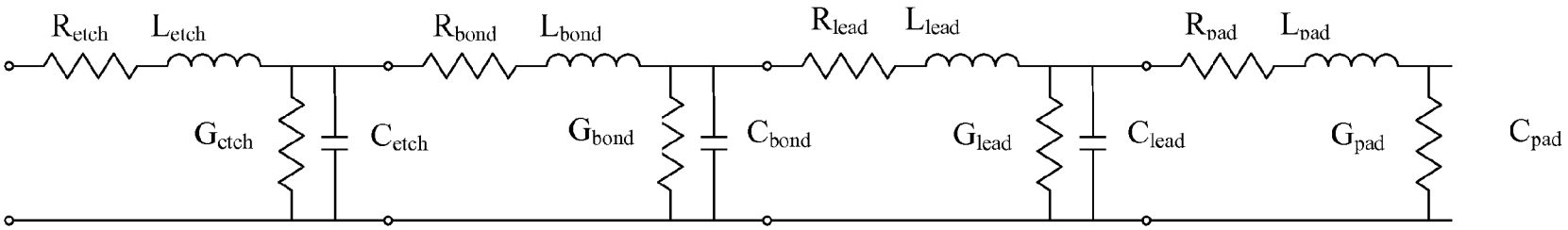
FIG. 5 depicts a circuit model for a conventional SATA connector plug on a PCB.

FIG. 5 is a transmission line circuit model diagram for the conventional SATA connector of FIG. 1 mounted on a PCB. Each segment of like properties can be represented by a circuit diagram that is comprised of a series resistance (R), a series inductance (L), a capacitance (C) and a conductance (G). These four (4) properties define the characteristic impedance (Z) of the segment. From the cross-section of FIG. 3 as earlier explained, a path consisting of length of etch trace 208 on PCB 20 leading to a SMT pad 202 with a connector lead 231 electrically and mechanically bonded to the SMT pad 202 with solder 232 leading to a connector lead 231 is present in a conventional SATA compliant connector. As shown in FIG. 4, connector contact 230 included a wire profile section 233 that connected to SMT pad 202 to connector interconnect blade 212. Because these two sections have different geometries they are treated separately. Thus, the resulting circuit diagram model of FIG. 5 is divided into four segments of similar properties: etch, bond, lead, and pad. The etch trace 208 is a contiguous piece of copper of a generally uniform size and shape. The bond is actually several elements that are lumped into a single element; the SMT pad 202 is a different size and shape than the etch trace 208, while on the SMT pad 202, solder 232 bonds a lead 231 of a different geometry and material than etch trace 208. Lead 233 between solder bond 232 and pad 202 is a generally uniform size and shape leading up to the connector pad 212 which has a different geometry and is typically plated with gold which further affects the characteristic impedance. In all, as those of skill will appreciate, many impedance discontinuities impede or distort the uniform propagation of signals through a conventional SATA connector.

Figure 6:
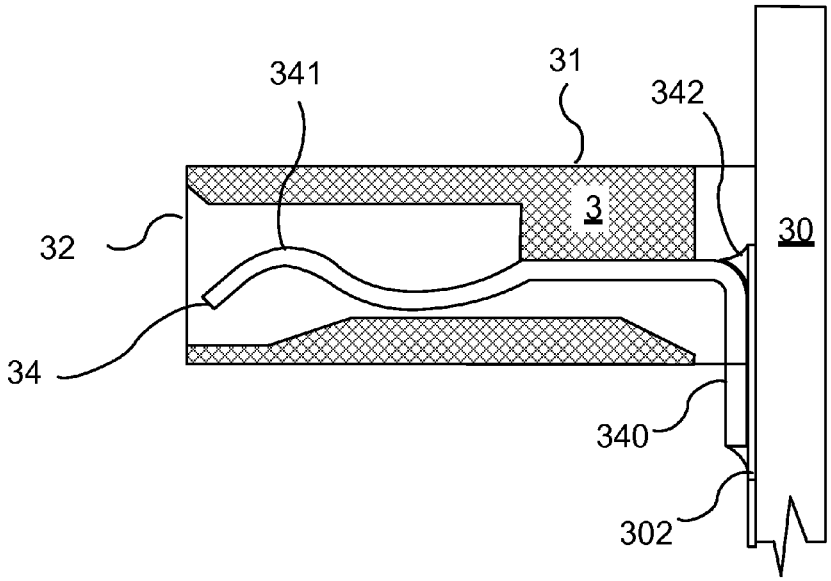
FIG. 6 depicts a cross section of a SATA connector female receptacle

FIG. 6 depicts a cross section of a SATA receptacle connector 3. SATA receptacle connector 3 is comprised of a connector body 31 that supports a contact 34 and forms an opening 32 for insertion of a SATA compliant plug connector 2. The contact region 341 of contact 34 of a plug connector wipes across a SATA complaint plug blade 212 (not shown in FIG. 6 but seen in other Figs.) and makes an electrical connection when the SATA compliant plug connector 2 is inserted. The receptacle connector is typically mounted to a host PCB 30. The method of electrical attachment shown in FIG. 6 is a surface mount attach. In this method, a SMT lead 340 is formed on the end of the contact 34 and electrically bonded to SMT pad 302 with solder 342.

Figure 7:
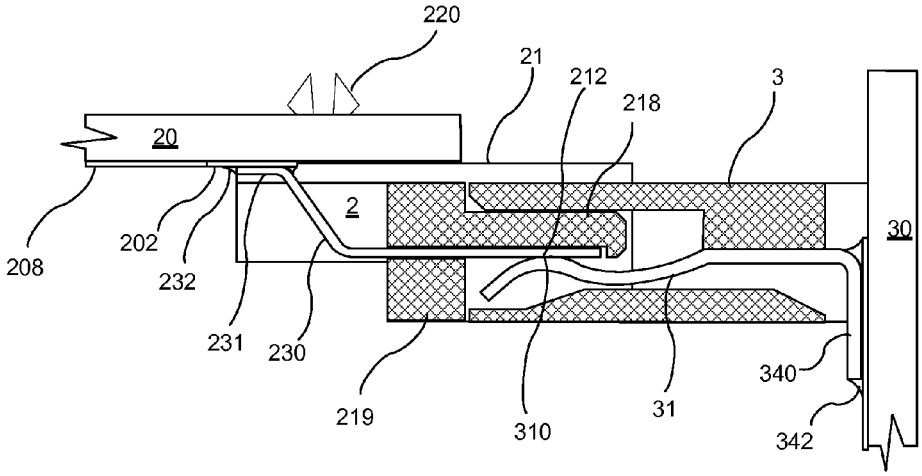
FIG. 7 depicts the cross section of a male-female mated pair of conventional SATA connectors.

FIG. 7 shows SATA plug connector 2 inserted in the SATA receptacle connector 3.

Figure 8:
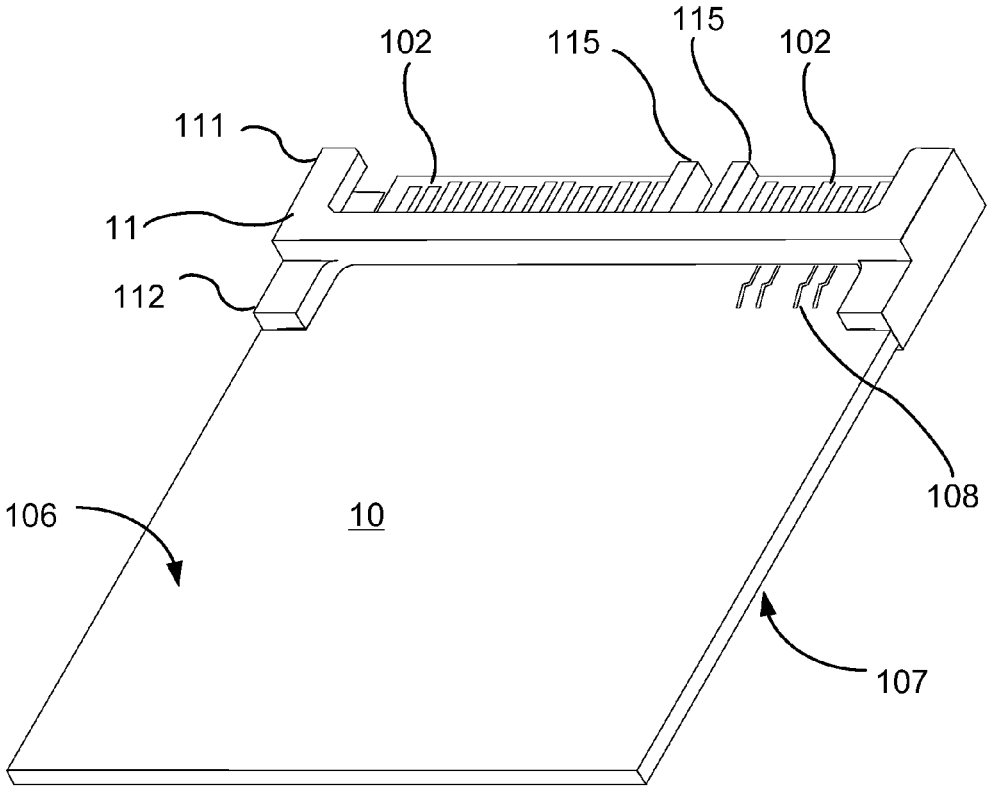
FIG. 8 depicts an isometric view of an embodiment of the present invention.

In FIG. 8, an embodiment of the present invention is shown depicting connector housing 11 inserted onto the end of PCB 10. Shown are first PCB side 106 and second PCB side 107.

Figure 9A:
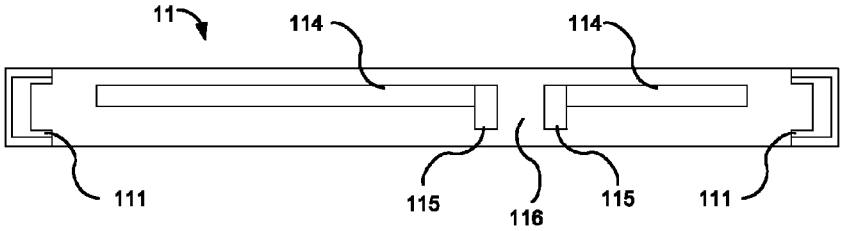
FIGS. 9A, 9B, and 9C depict mechanical features of an embodiment of the present invention.
Figure 9B:
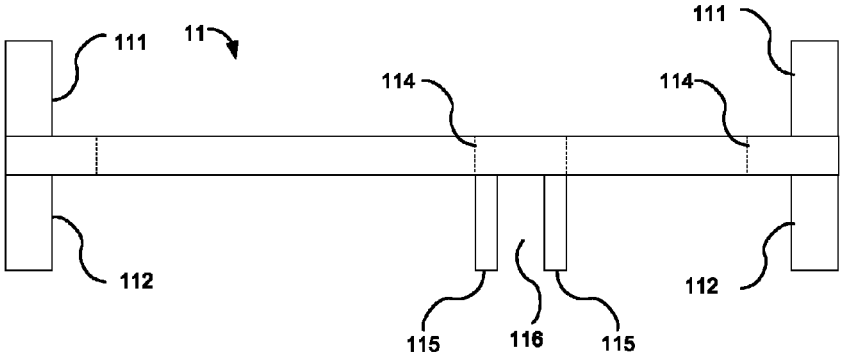
Figure 9C:
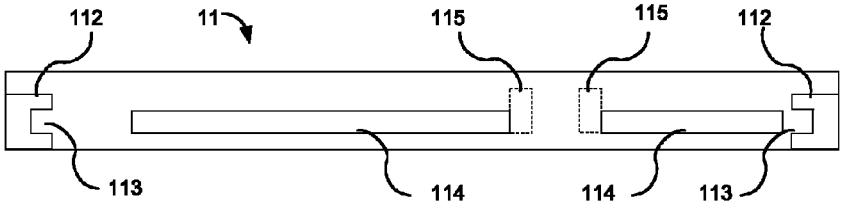

FIGS. 9A, 9B, and 9C depict various mechanical aspects of connector housing 11 in an embodiment of the present invention. In FIG. 9A, connector housing 11 is viewed from the front end that plugs into the SATA receptacle connector 3. On either side of connector housing 11, there are guide posts 111 that align module 1 with SATA receptacle connector 3 which thus enables blind mating. Keys 115 and space 116 are positioned to allow mating with compatible connectors. Slots 114 in connector housing 11 allow PCB 10 bearing contacts 102 on its respective tabs 101 to be installed through slots 114 to form the electrical contacts and their supporting member.

FIG. 9B shows a top down view of connector housing 11. Guide posts 111 extend from the connector housing to mate with the receptacle connector. Keys 115 extend from the connector housing 11. The dashed lines indicate the location of slots 114 through which PCB 10 emerges. Another element shown in this view is the guides 112 for PCB 10.

FIG. 9C shows the PCB side of connector housing 11. PCB guides 112 are on either side of the connector housing 11 and have a guide slot 113 that fits over the edges of PCB 10. Tabs 101 of PCB 10 pass through connector housing 11 through slots 114.

Figure 10:
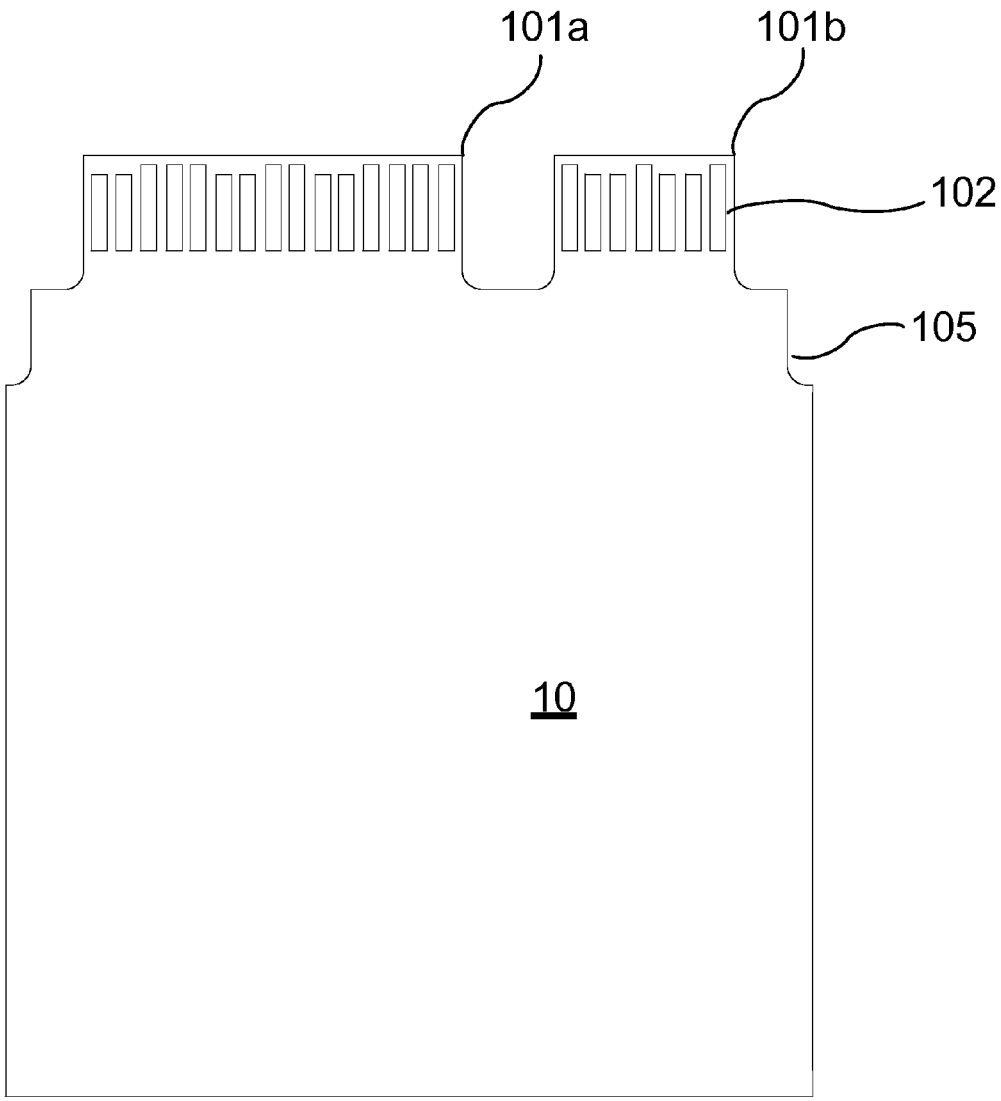
FIG. 10 depicts the outline of an example PCB for use in an embodiment of the present invention.

PCB 10 as used in an embodiment is shown in FIG. 10. A top view of PCB 10 is depicted. The end of PCB 10 is shaped to have tabs 101 that pass through slots 114 in connector housing 11. The length of tabs 101 and the thickness of PCB 10 at tabs 101 substantially match the thickness of the blade of plug connector 2 as compliant with the SATA specification. Disposed on tabs 101 are contacts 102 that are positioned and sized to mate with contact 34 in the SATA receptacle connector 3. The width of PCB 10 immediately behind tabs 101 fits in guide slots 113 in PCB guides 112. PCB 10 in FIG. 10 has a width greater than the distance inside slots 113 so PCB 10 has notches 105 to allow the connector housing 11 to fit on PCB 10.

Figure 11:
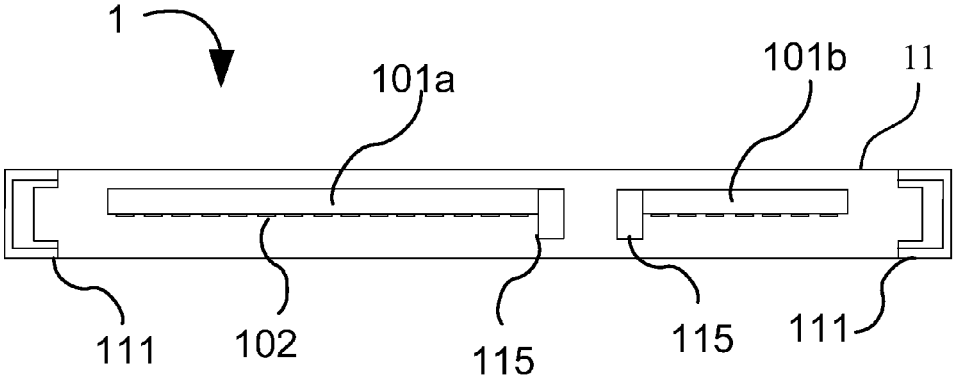
FIG. 11 depicts the connector end-on view of an embodiment of the present invention.

FIG. 11 shows a frontal view of module 1 in accordance with a preferred embodiment of the present invention. The two PCB tabs 101*a* and 101*b* with contacts 102 extend through connector housing 11 and align with keys 115 that align with slots in the SATA receptacle connector 3. Guide posts 111 allow for blind mating with the SATA receptacle connector 3.

Figure 12:
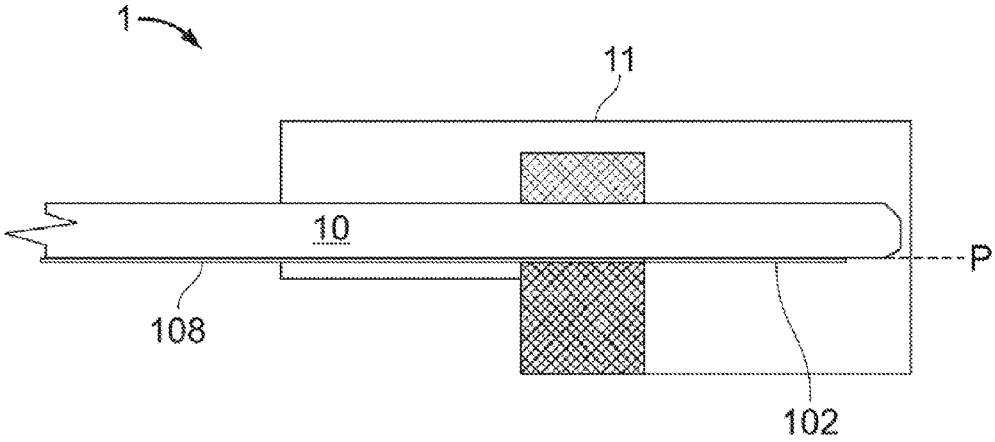
FIG. 12 depicts a cross-sectional view of a male ended connector embodiment.

FIG. 12 depicts aspects of exemplar connector module 1 in a cross sectional view. Module 1 is comprised of a connector housing 11 that is similar to the connector housing 21 of the conventional SATA plug connector 2 and is compatible with the SATA receptacle connector 3. Module 1 connector housing 11 fits over a section of PCB 10 that has one or more contacts 102 disposed on one side of the PCB 10. The reference "T" refers to the thickness of PCB 10 which as shown extends out to the blade area 13 that bears one or more contacts 102. The thickness T of PCB 10 is substantially equal to the thickness of a standard SATA plug connector blade in accordance the SATA Specification which is known to those of skill in the art. In particular, that specification starting at page 79 is relevant to the dimensional specifications for a SATA plug and thus, in an embodiment, the thickness T of PCB 10 is substantially equal to the thickness specified in the SATA Specification for a blade in connectors compliant with that specification.

The contacts 102 are shown in FIG. 12 as being on the first PCB side 106 of a tab area 13 of PCB 10 and, as shown, etch trace 108 and contact 102 are coincident along the plane "P" of the first PCB side 106 of PCB 10. One skilled in the art can appreciate that one or more contacts 102 could be disposed on the second side 107 of PCB 10 to create a connector with contacts on both sides of the blade as is used in a Serial Attached SCSI (SAS) connector. Comparing module 1 as opposed to the conventional SATA plug connector 2, module 1 does not require the additional contact 230 of a traditional SATA plug as shown in FIG. 3 and thus, has a simplified circuit model diagram and, fewer impedance discontinuities.

Figure 13:
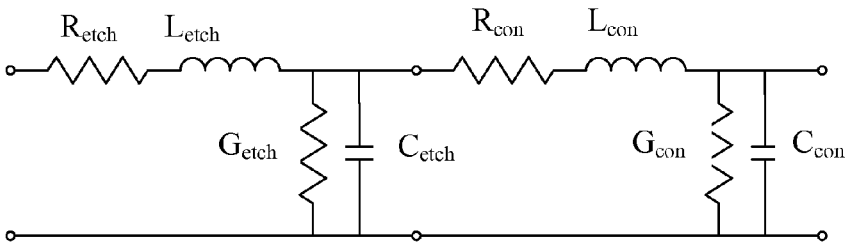
FIG. 13 depicts a circuit model for an embodiment of the present invention.

A circuit diagram model of module 1 is shown in FIG. 13. As shown in FIG. 13, etch trace 108 of PCB 10 leads directly into the contact pad 102 thus eliminating the SMT bond and lead segments from the circuit diagram of FIG. 5. Further, in the depicted embodiment, contact pad 102 is constructed of the same material and is substantially the same thickness as the etch trace 108, thus further reducing the difference in characteristic impedance due to differing geometries. Thus, the circuit diagram is reduced to a segment for etch trace 108 with a resistive (Retch), Inductive (Letch) conductance (Getch) and Capactive (Cetch) component and a segment for the contact with a resistive (Rcon), Inductive (Lcon) conductance (Gcon) and Capactive (Ccon) component.

Figure 14:
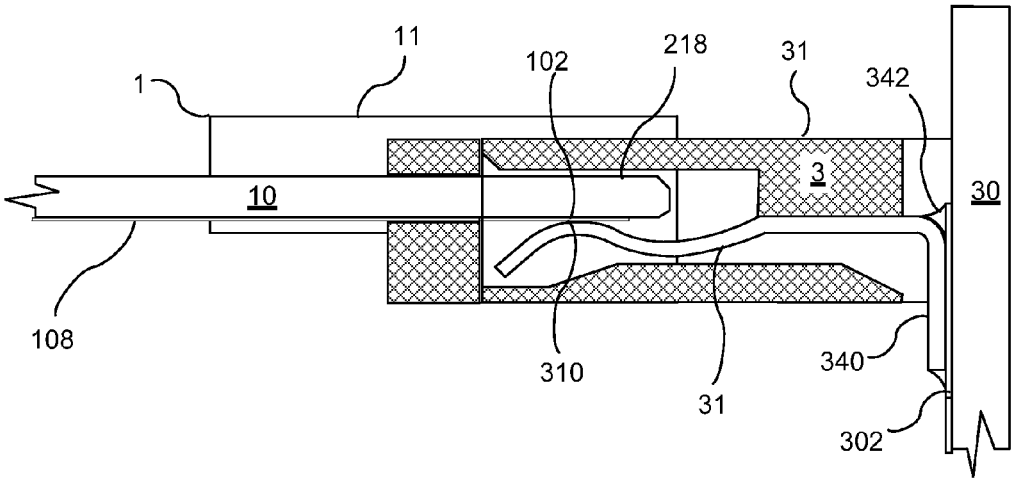
FIG. 14 depicts the cross-section of a male ended connector in accordance with an embodiment of the present invention as mated with a conventional SATA receptacle connector.

FIG. 14 shows module 1 inserted in a SATA receptacle connector 3. Module 1 does not require the additional contact structure that a conventional SATA plug connector 2 requires.

The mechanical specification for a SATA plug connector 2 is defined by Serial ATA International Organization (SATAIO) as those of skill will recognize. The SATA interface is used by many storage devices and module 1 creates a SATA compliant plug connector that has superior electrical performance and lower cost than the conventional SATA plug connector 2. One skilled in the art will recognize that embodiments of the present invention may be used in other SATA connector embodiments or in other connectors that have a similar contact and blade configuration.

Figure 15:
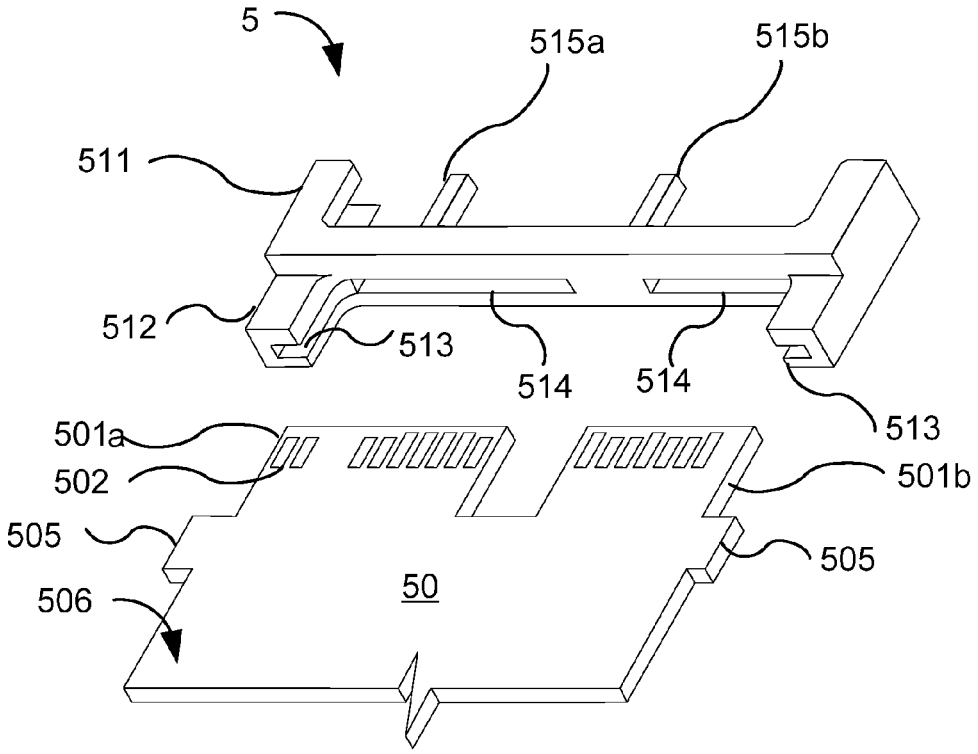
FIG. 15 depicts an exploded isometric view of a microSATA alternative embodiment of the present invention.

FIG. 15 depicts an exploded isometric view of an alternative embodiment 5 of the present invention 1. Shown are PCB 50 and connector housing 511. The general class of connector depicted is known in the industry as a microSATA connector. In this alternative embodiment 5, one key 515*a* is located so it is along the surface 506 of and within the span of emergent tab 501 while the other key 515*b* is located on an edge of tab 501.

In this embodiment 5, tab 501*b* as configured at the end of PCB 50 is smaller than the other tab 501. Being smaller, it has fewer contacts 502 disposed on the contact bearing surface 506. One familiar with the art can appreciated that the contacts 502 could be smaller or larger to meet the particular needs of the application. In addition to having fewer contacts 502 due to the reduction in width, there are one or more possible contact locations that have been left unpopulated.

Figure 16:
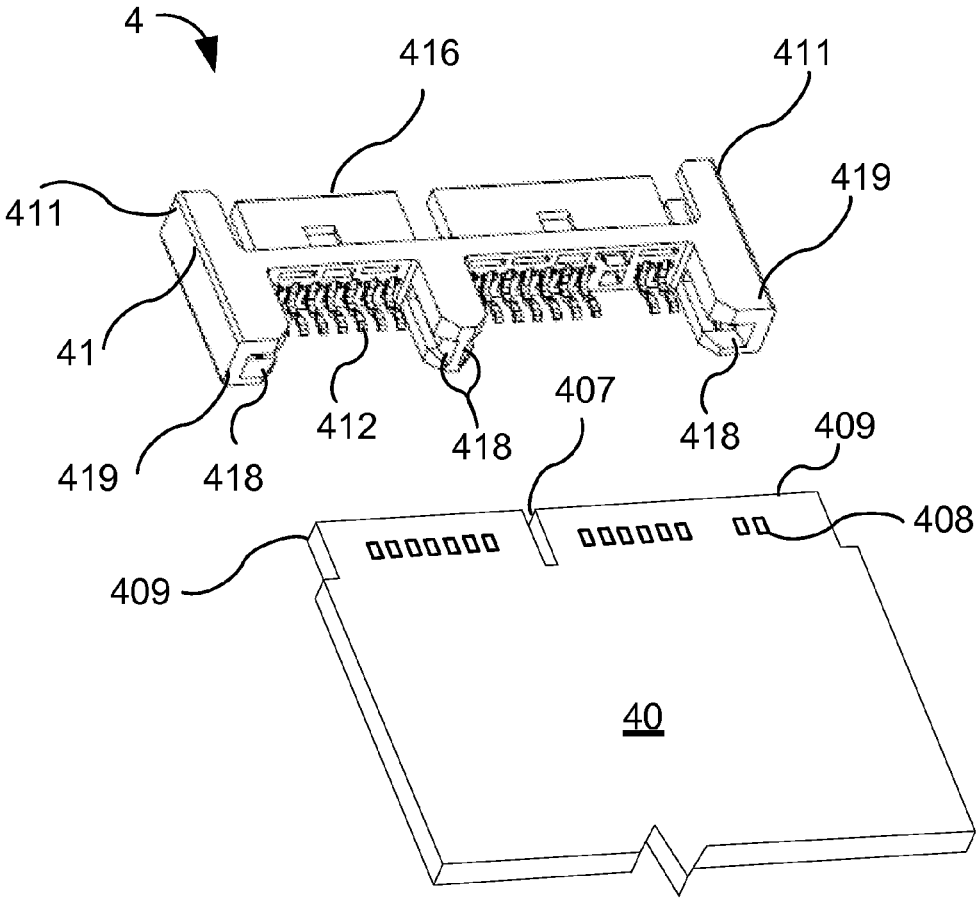
FIG. 16 depicts an exploded isometric view of a conventional microSATA connector showing its PCB.

FIG. 16 depicts an isometric view of a conventional microSATA plug connector 4. The version of the connector shown is a commonly known as a straddle mount. It is called a straddle mount because it straddles the end of the PCB 10 that it is mounted to rather than being placed on a surface of a module like the earlier shown SATA plug connector 2. There are guide posts 411 that fit onto features of PCB 40 that position the connector so that leads 412 from connector 41 will align with SMT pads 408 on PCB 40 that accepts this connector 41.

There are distinctions between PCB 40 of FIG. 16 and PCB 50 of FIG. 15 that should be noted. The straddle mount microSATA plug connector 4 is conceptually an extension of PCB 40. While the end of the PCB part of module has been shaped into two tabs 409 this is only to provide centering of the housing 41 at the end of PCB 40 and provide mechanical support for the housing 41. The slot 407 that appears to create two tabs 409 is a reference point to locate the straddle mount for microSATA plug housing 41 so that leads 412 align with surface mount pads 408 on PCB 40. Tabs 409 do not pass through housing 41 nor do surface mount pads 408 form the mating surface when the microSATA plug connector is inserted into a microSATA receptacle connector. The straddle mount SATA plug connector has the same signal path that is detailed in the cross section of FIG. 3 with the equivalent circuit diagram model of FIG. 5, while module 5 (FIG. 15) has the equivalent circuit diagram model of FIG. 13.

Figure 17A:
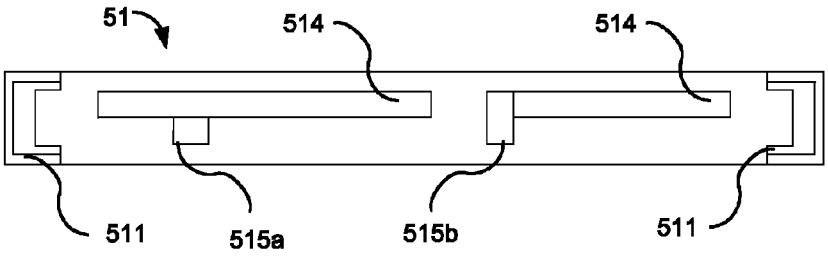
FIGS. 17A, 17B, and 17C depict various mechanical features for a microSATA alternative embodiment of the present invention.
Figure 17B:
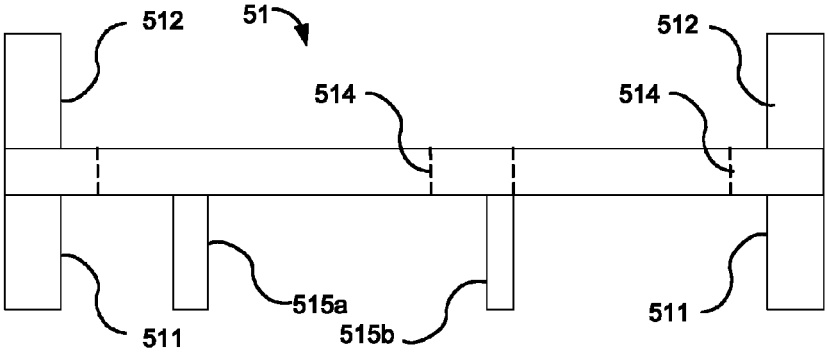
Figure 17C:
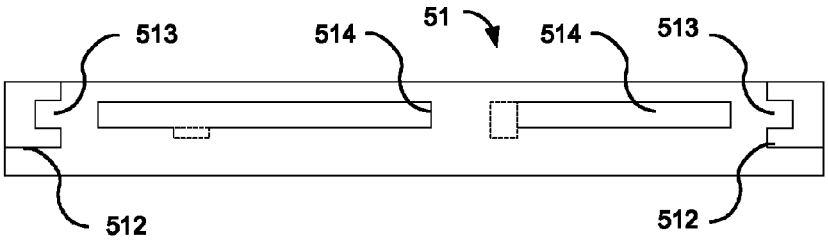

FIGS. 17A, 17B and 17C depict various mechanical aspects of connector housing 51 as deployed with module 5.

In FIG. 17A, the module 5 connector housing 51 is viewed from the front. On either side of the connector there are guide posts 511 that align module 5 with a microSATA receptacle connector thus enabling blind mating. Keys 515*a* & *b* are positioned to allow mating with compatible connectors.

FIG. 17B shows a top down view of connector housing 51. Guide posts 511 extend from connector housing 51 for mating with a receptacle connector. Additionally, keys 515*a* and 515*b* extend from connector housing 51. The dashed lines indicate the location of slots 514 through which PCB 50 is mounted. Depicted guides 512 for PCB 50 add additional support for connector housing 51.

FIG. 17C shows the PCB side of the connector housing 51. PCB guides 512 are on either side of connector housing 51 and have a slot 513 that fits about the edges of PCB 51. Through slots 51 are where tabs 501 of PCB 50 pass through connector housing 51.

Figure 18:
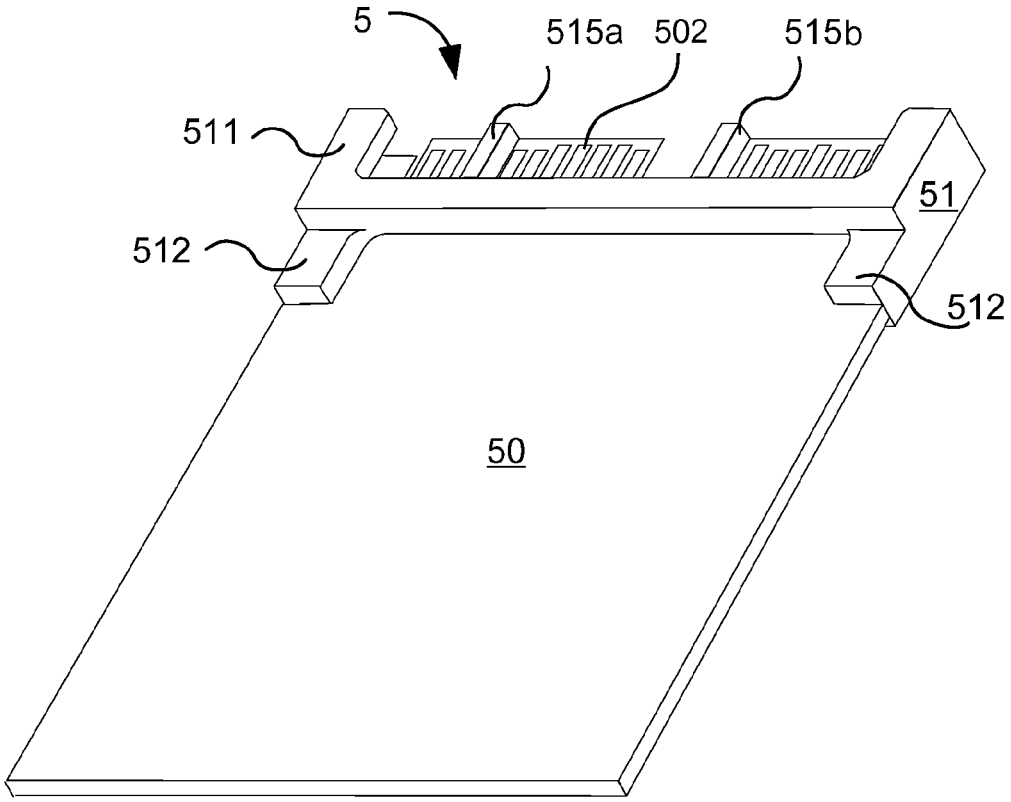
FIG. 18 depicts an isometric view of a microSATA connector alternative embodiment of the present invention.

FIG. 18 is a depiction of module 5, an alternative embodiment. In FIG. 18, connector housing 51 has been inserted onto PCB 50. In this view, as described earlier, key 515*a* can be seen disposed along the surface of one of tabs 501 and within that tab's contacts 502.

Figure 19:
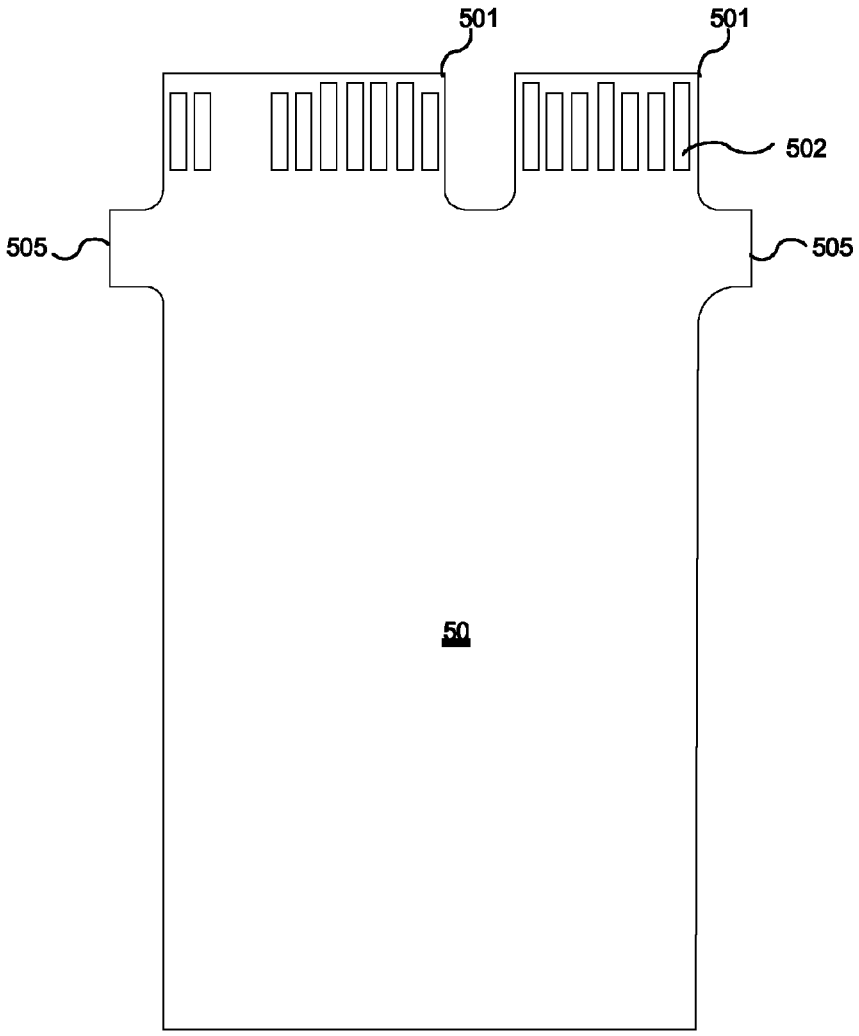
FIG. 19 depicts an outline of an exemplary PCB for use with a microSATA alternative embodiment of the present invention.

A PCB used in module 5 is shown in FIG. 19 in a top down view. The end of PCB 50 that is used to form module 5 is shaped to have tabs 501 for passage through slots 514 in connector housing 51 of FIG. 18. The length of tabs 501 and the thickness of PCB 50 correspond to the thickness of the blades of a microSATA connector. Disposed on tabs 501 are contacts 502 that are positioned and sized to mate with the contact 34 in the microSATA receptacle connector 3. The width of PCB 50 immediately behind the tabs 501 is configured to fit in slots 513 in PCB guides 512. PCB 50 in FIG. 19 has a width less than the distance inside slots 513 so PCB 50 has tabs 505 to allow connector housing 51 to fit on PCB 50.

Figure 20:
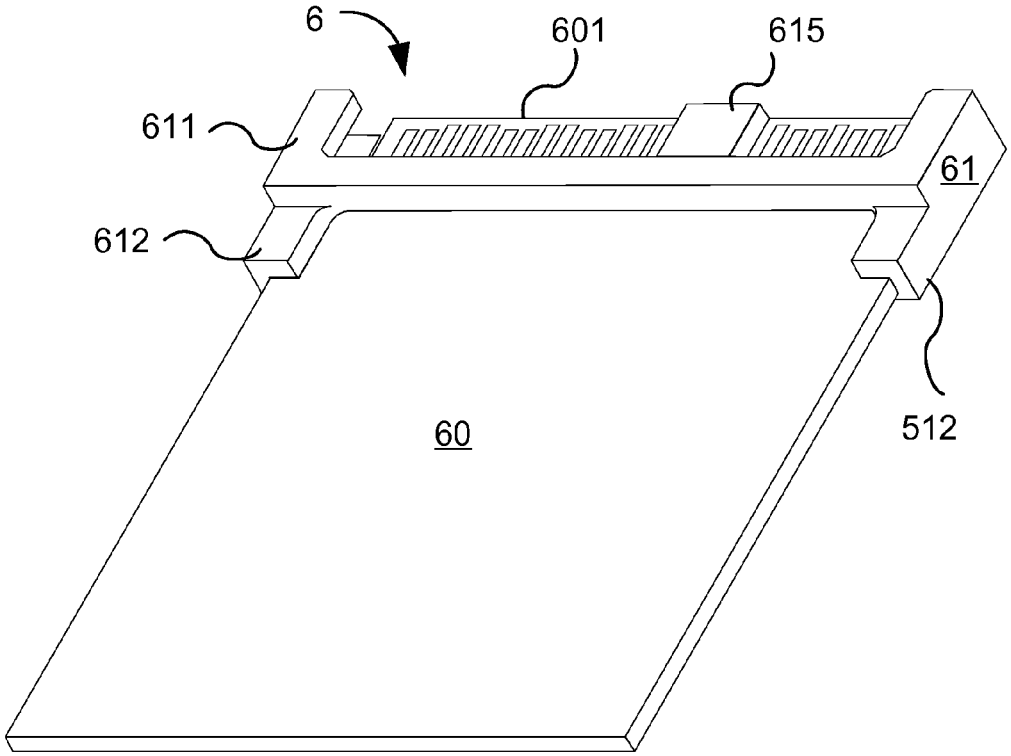
FIG. 20 depicts an isometric view of yet another alternative embodiment that implements a SAS connector.

FIG. 20 shows yet another embodiment of the present invention. Depicted module 6 is an embodiment of a connector that is configured to mate with a Serial Attached SCSI (SAS) receptacle connector that is compliant with a SAS specification. One commonly referenced SAS specification is the SFF-8680 Specification for Serial Attachment 12 Gb/s 2× Unshielded Connector, Rev. 1.5 published Jun. 15, 2012 which is hereby incorporated by reference (the "SAS Specification"). In the SAS Specification, the dimensional requirements for a SATA compliant connector are stated (e.g., blade width and thickness and spacing) and when reference is herein made to a dimension in comparison to a conventional SAS compliant connector, reference is being made to a SAS specification that states the subject dimension and such a SATA specification is the SAS Specification identified above.

Figure 21A:
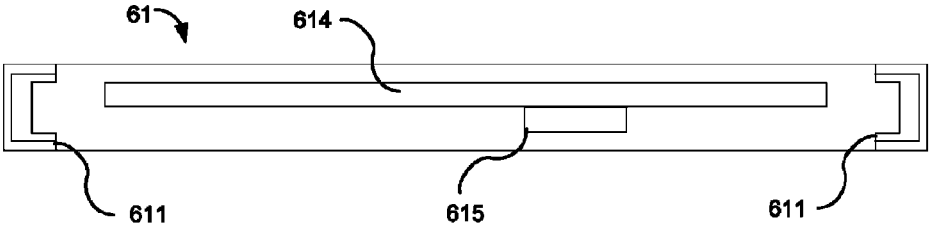
FIGS. 21A, 21B, and 21C show various aspects of mechanical features for a SAS alternative embodiment of the present invention.
Figure 21B:
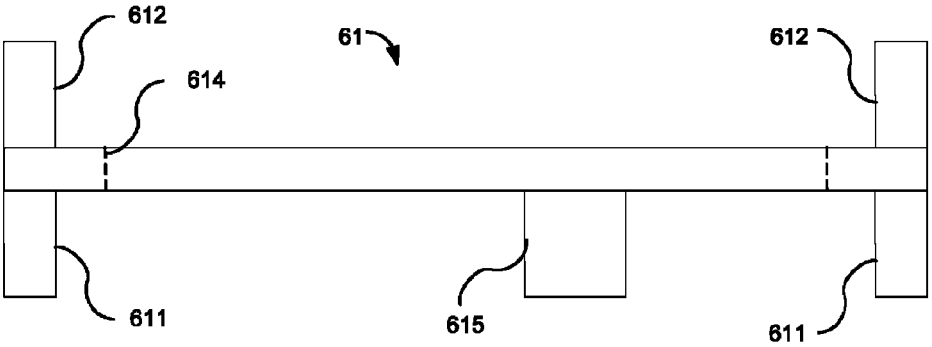
Figure 21C:
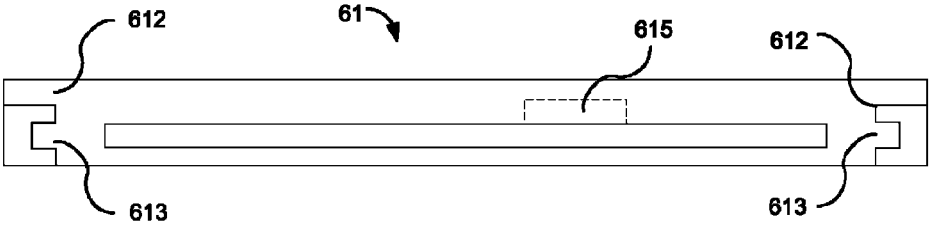

FIGS. 21A, 21B, and 21C depict various mechanical aspects of module 6 of connector housing 61. In FIG. 21A, the module 6 connector housing 61 is viewed from the front. On either side of connector housing 61, there are guide posts 611 allow alignment of module 6 with a SAS compliant receptacle connector enabling blind mating. Keys 115 and space 116 of module 1, shown earlier, have been replaced with one long tab 615.

As shown in FIG. 21A, the two slots 114 in connector housing 11 of earlier shown module 1 have been replaced with one long slot 614 where PCB 60 with disposed contacts 602 may be installed through slot 614 forming electrical contacts 602 and supporting member 601. In module 6, the contact bearing blade 601 protruding through slot 614 has contacts disposed on the first and second surfaces of PCB 60.

FIG. 21B shows a top view of connector housing 61. Guide posts 611 extend from connector housing 61 to mate with a SAS receptacle connector. Additionally, the single wide key 615 extends from connector housing 61. The dashed lines indicate the location of slot 614 through which PCB 60 mounts. Guides 612 add additional support for connector housing 61 to PCB 60.

FIG. 21C shows the PCB side of connector housing 61. PCB guides 612 are on either side of connector housing 61 and have a slot 613 that fits over the edges of PCB 60.

Figure 22:
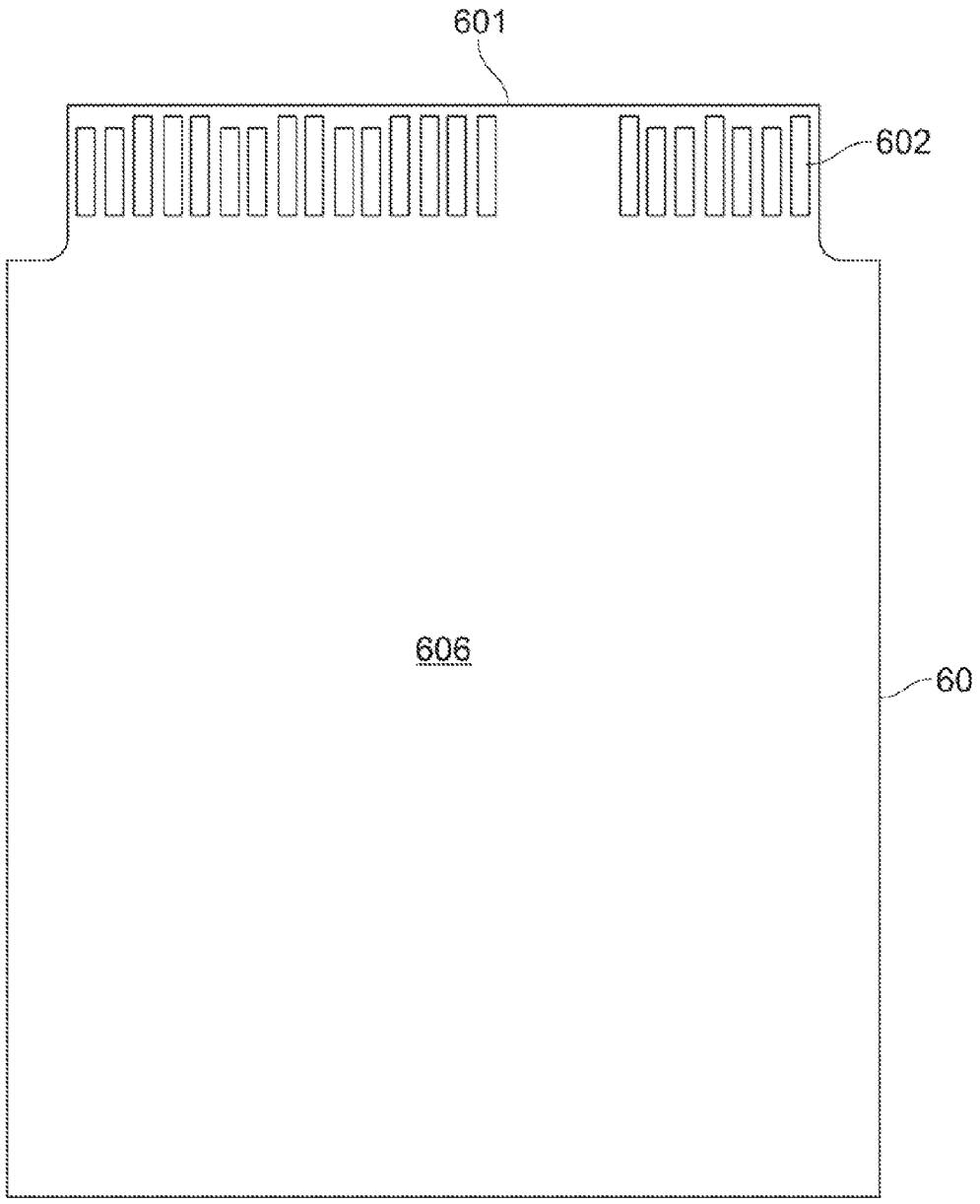
FIG. 22 depicts an outline and first surface of an exemplary PCB for use with a SAS alternative embodiment of the present invention.

The first top side 606 of PCB 60 used in module 6 is shown in FIG. 22. The end of PCB 60 that is used in module 6 is shaped to have a tab 601 that passes through slot 614 of connector housing 61 as shown in FIG. 21C. Preferably, the length of tab 601 and the thickness of PCB 60 at tab 601 substantially matches the thickness of the blade of a SAS connector. Disposed on tab 601 are contacts 602 that are positioned and sized to mate with a contact in a SAS compliant receptacle connector similar to the contact 34 in the SATA compliant receptacle connector 3. The width of PCB 60 immediately behind tab 601 is disposed in slots 613 in the PCB guides 612. PCB 60 in FIG. 22 has a width commensurate with the distance inside slots 613 so PCB 60 does not need notches 105 of PCB 10 of the earlier shown module 1 to allow connector housing 61 to fit on PCB 60.

Figure 23:
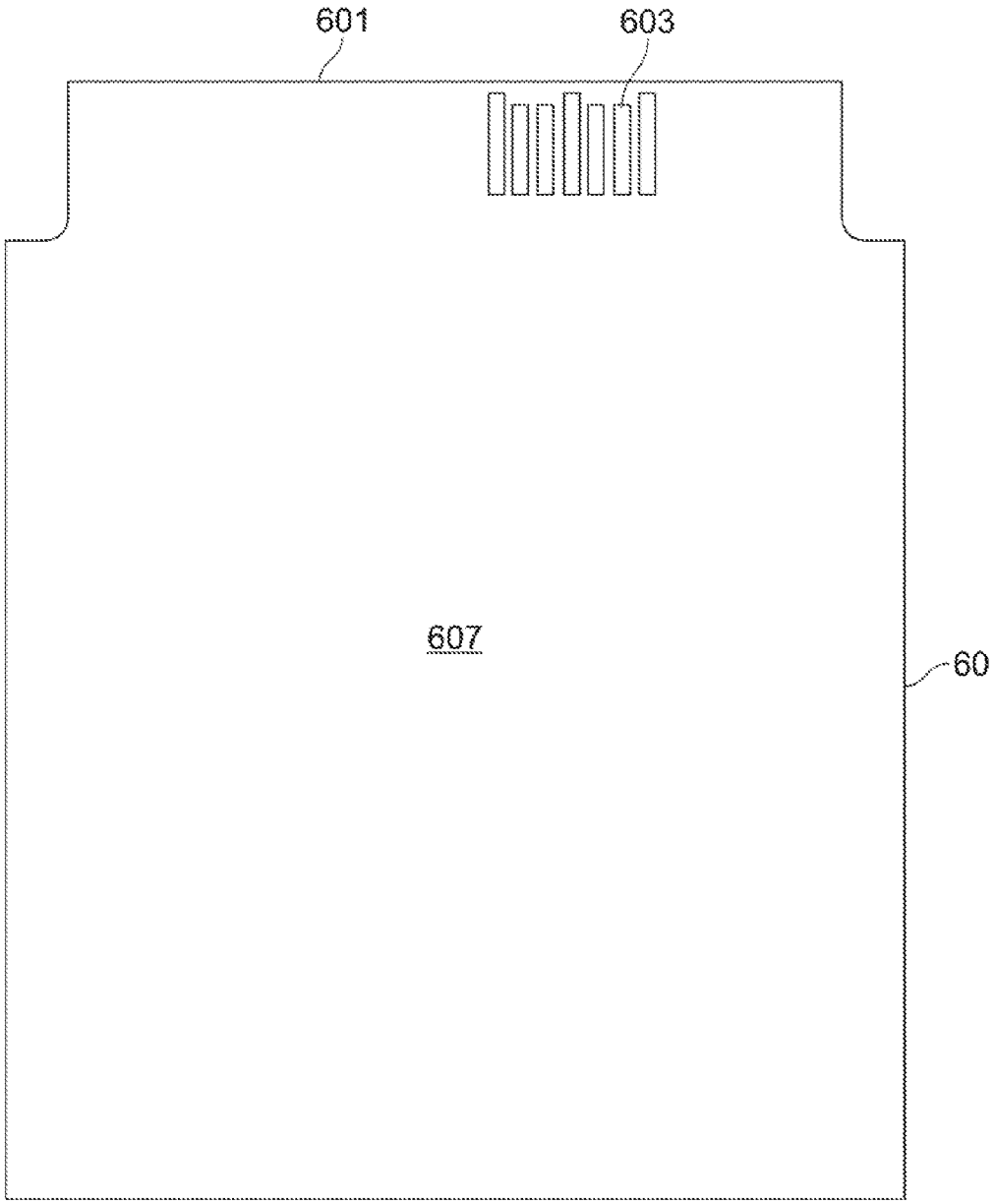
FIG. 23 depicts an outline and second surface of an exemplary PCB for use with a SAS alternative embodiment of the present invention.

FIG. 23 shows the second bottom side 607 of PCB 60 used in module 6. Module 6 connector has a double sided blade 601. There are contacts 602 disposed on both the bottom side 607 as well as the top side 606 of PCB 60.

Figure 24:
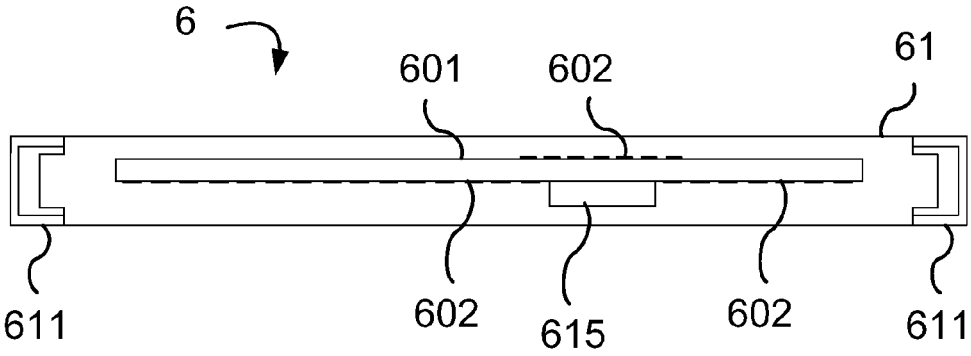
FIG. 24 depicts a connector end-on view of a SAS alternative embodiment of the present invention.

FIG. 24 shows the connector end view of module 6. This view shows contacts 602 on the first side 606 and the second side 607.

Figure 25:
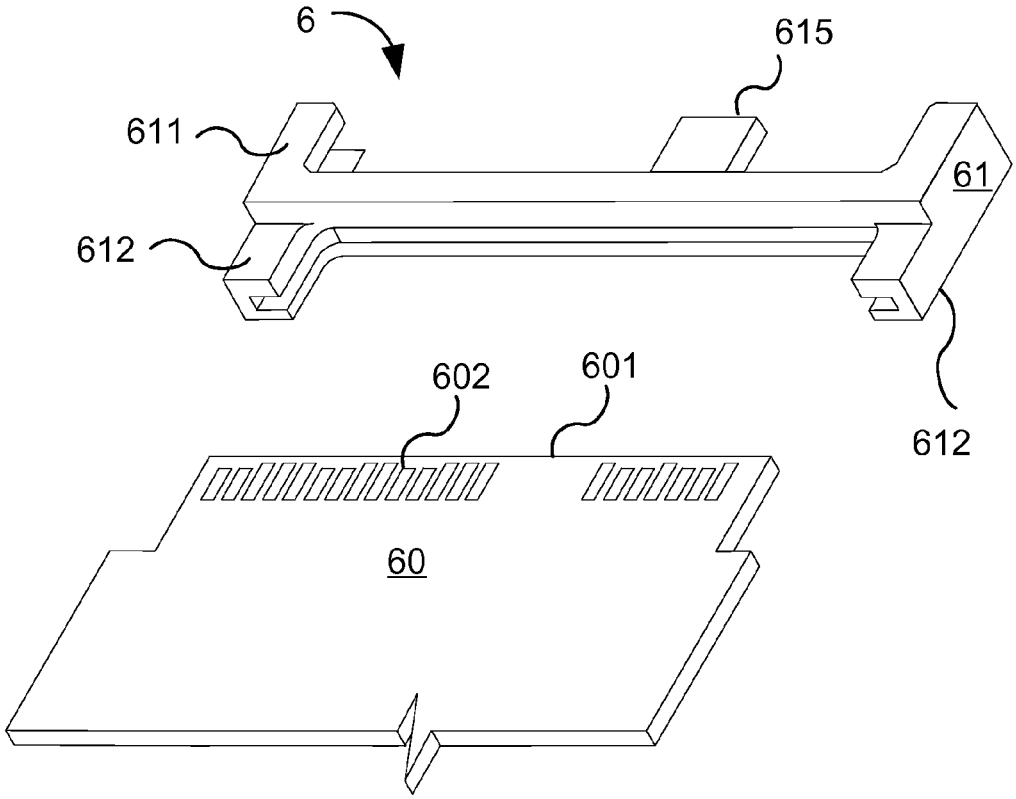
FIG. 25 depicts an exploded isometric view of a SAS compliant connector in accordance with an embodiment of the present invention.

FIG. 25 depicts an exploded isometric view of module 6 showing PCB 60 and connector housing 61.

Figure 26:
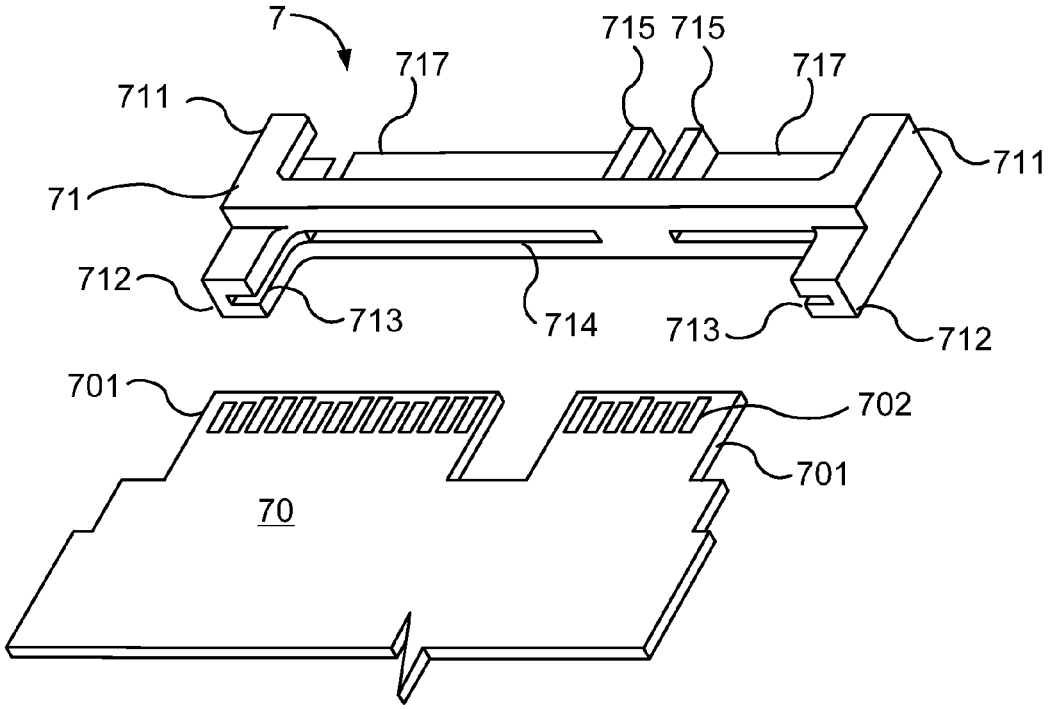
FIG. 26 depicts an exploded isometric view of a thin PCB alternative embodiment.

FIG. 26 depicts a thin module 7 that employs a thin PCB 70 that is thinner than blade 26 of a conventional SATA plug connector 2. Shown are printed circuit board 70 and connector housing 71. In module 7, a shim 717 is added to connector housing 71. The addition of the thickness of the shim to the thickness of tab 701 results in the combination being substantially as thick as blade 26 of the conventional SATA compliant plug connector 2.

Figure 27A:
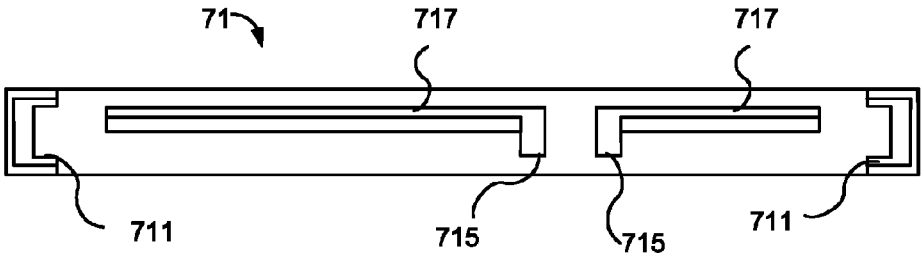
FIGS. 27A, 27B, and 27C show various aspects of the mechanical features for a thin PCB alternative embodiment connector housing.
Figure 27B:
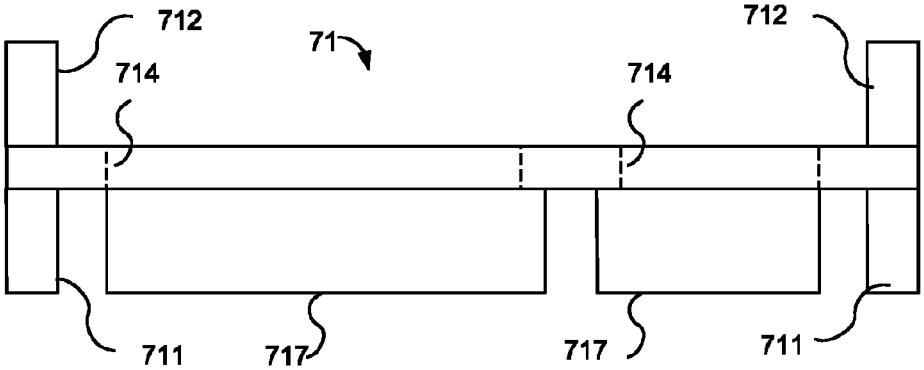
Figure 27C:
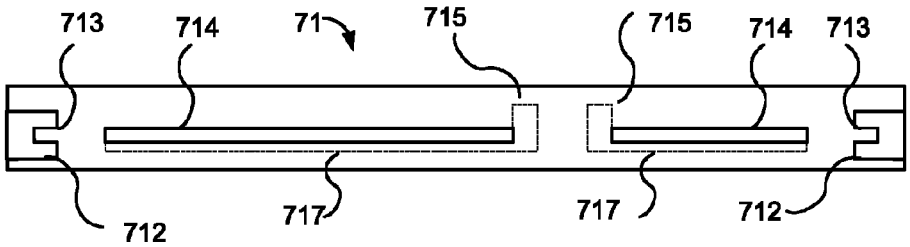

FIGS. 27A, 27B, and 27C depict various mechanical aspects of a connector housing 71 for module 7 in which PCB 70 is thinner than blade 26 of a conventional SATA compliant plug connector 2. In FIG. 27A, connector housing 71 is viewed from the front. In this view, shim 717 is molded into the thin PCB connector housing 71. Slot 714 for thin PCB 70 is thinner due to shim 717 being positioned over the portion of slot 714 that is not needed to accommodate a thicker module such as PCB 10.

FIG. 27B shows a top view of module 7 connector housing 71. Here it can be seen that shim 717 extends from connector housing 71 the length of key 715 and is the width of slot 714. One skilled in the art will appreciate that the shim need only be large enough to support the PCB tab 701 so that it make reliable contact with the mating contacts in the SATA receptacle connector 3. Further, shim 717 may be multiple sections rather that one contiguous section.

FIG. 27C shows the PCB side of connector housing 71. PCB guides 712 on either side of connector housing 71 have a thinner slot 713 that fits over the edges of thin PCB 70. The slots are only as tall as the through slots 714 where PCB tabs 710 on thin PCB 70 pass through thin PCB connector housing 71 to form connector blade 726.

Figure 28:
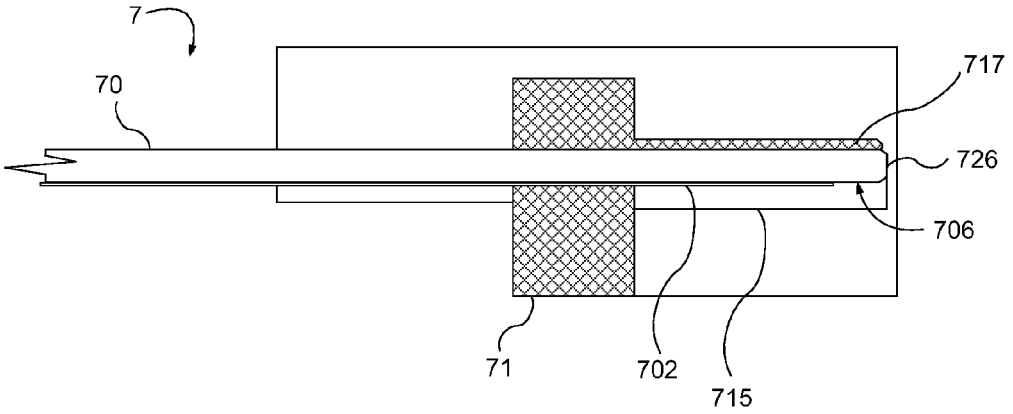
FIG. 28 depicts a cross-sectional of a thin PCB alternative embodiment.

FIG. 28 depicts a cross section of module 7. Thin module 7 has a shim 717 on the non-contact bearing surface 707 of tab 701. The additional thickness of shim 717 results in the contact bearing blade 726 conforming to the thickness requirements of a SATA plug connector 2. Depending upon the thickness of shim 717, the material may not be able to support itself. An adhesive 718 may be disposed between shim 717 and tab 701 when assembling the thin module 7.

The present invention can be used advantageously to increase the speed and reliability while reducing the footprint on the module of the plug connector in SATA or SAS storage subsystems of portable consumer electronics or a computing system.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments described in the specification. As one of ordinary skill in the art will readily appreciate from the disclosure of the present invention, the structures, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, structures, machines, manufacture, compositions of matter, means, methods, or steps.

I claim:

1. A connector for coupling a computer peripheral device with a SATA compliant socket, the connector comprising:

a PCB having a first PCB side and a second PCB side and a thickness substantially equal to the thickness specified for the connector blade in the SATA Specification, the PCB having two edges along each of which edges are configured a set of PCB steps;

the PCB being configured with a first tab and a second tab, the first tab having substantially the same width as specified by the SATA Specification for a signal blade and the first tab having electrical contacts disposed on its first PCB side of the same number, and substantially the same size and position as specified in the SATA Specification for the signal blade;

the second tab being substantially the same size and shape as the power blade as specified in the SATA Specification for a power blade and having electrical contacts disposed on its first PCB side of the same number, and substantially the same size and position as specified in the SATA Specification for the power blade;

the first and second tabs positioned the substantially the same distance apart as specified in the SATA Specification for separation between the power and signal blades; and each of the electrical contacts of the first and second tabs being connected to one or more respective etch traces borne on the first PCB side of the PCB so that the one or more etch traces and the electrical contacts are substantially coincident along the plane defined by the first PCB surface.

2. The connector of claim 1 further comprising a third tab of the PCB, the third tab having one or more electrical contacts on the first PCB surface of the third tab.

3. The connector of claim 1 wherein the connector is a microSATA plug connector.

4. The connector of claim 1 wherein the electrical contacts are arranged in a manner other than in compliance with the requirements of the SATA Specification.

5. The connector of claim 1 further comprising a connector housing having a front portion and a rear portion, the rear portion of the connector housing having a pair of laterally-opposed guide arms with guide slots through which the PCB is disposed, the guide arms each being internally configured with a set of guide arms steps each of which guide arm steps corresponding to one of the PCB steps;

the connector housing having a first slot and a second slot from which emerge, respectively, the first and second tabs;

the connector housing having a first protrusion adjacent to the first tab slot, the first protrusion being substantially the size and shape of the key for the signal tab as specified in the SATA Specification;

the connector housing having a second protrusion adjacent to the second tab slot, the second protrusion being substantially the size and shape of the key for the power tab as specified in the SATA Specification.

6. The connector of claim 5 in which the front portion of the connector housing has a pair of laterally-opposed differently-sized polygonally-shaped guide arm receiving cavities being integrally formed with the connector housing and disposed in line with the first and second tabs, the guide arm receiving cavities adapted for mating with a SATA compliant receptacle connector.

7. An integrally-formed connector for coupling a computer peripheral device with a SATA compliant storage socket, the connector comprising:

a PCB with a first PCB surface and a second PCB surface, the PCB having two edges along each of which edges are configured a set of PCB steps;

the PCB having a thickness less than the thickness dimension specified in the SATA Specification for a plug connector blade;

the PCB configured with a first tab and a second tab and a first lateral tab and a second lateral tab;

the first tab formed to be substantially the same size and shape as specified in the SATA Specification for a signal blade;

the second tab formed to be substantially the same size and shape as specified in the SATA Specification for a power blade;

the first tab having electrical contacts disposed on the first PCB surface of the same number, and substantially the same size and position as specified in the SATA Specification for the signal blade, each of the electrical contacts of the first tab being connected to one or more respective etch traces borne on the first PCB surface of the PCB so that the one or more etch traces and electrical contacts are substantially coincident along the plane defined by the first PCB surface;

the second tab having electrical contacts disposed on the first PCB surface of the same number, and substantially the same size and position as specified by the SATA Specification for the power blade;

the first tab and second tabs being positioned apart substantially as specified in the SATA Specification for signal blade and power blade separation;

a connector housing;

the connector housing having a front portion and a rear portion;

the rear portion having a pair of laterally-opposed guide arms with guide slots into which are disposed the first and second lateral tabs of the PCB, the guide slots being internally configured with a set of guide arm steps that correspond to the set of PCB steps;

the connector housing having a first slot and a second slot through which emerge, respectively, the first and second tabs of the PCB;

the front portion of the connector housing having a first polygonally-shaped protrusion adjacent to the first tab slot;

the first protrusion and first tab being together compliant with dimensional requirements for the signal tab as specified in the SATA Specification for a SATA compliant plug connector;

the front portion having a pair of laterally-opposed differently-sized polygonally-shaped guide arm receiving cavities being integrally formed with the housing and being disposed in line with the signal blade and the power blade, the guide arm receiving cavities adapted for mating with a SATA receptacle connector.

8. The connector of claim 7 further comprising a third tab and the third tab bears electrical contacts.

9. The connector of claim 7 wherein the connector is a microSATA plug connector.

10. The connector of claim 7 wherein the electrical contacts are not arranged in compliance with the SATA specification.

11. The connector of claim 7 absent keys compliant with the SATA specification.

12. An integrally-formed connector for coupling a computer peripheral device with a Serial Attached SCSI (SAS) compliant storage socket, the connector comprising:

a PCB with a first major surface, a second major surface and four sides the PCB having two edges along each of which edges are configured a set of PCB steps;

the PCB having a thickness that is equal to the thickness of a SAS compliant plug connector blade as specified in the SAS Specification;

the PCB having one of the four sides dedicated to interconnection with a host device;

the side of the PCB dedicated to interconnection with a host device configured to form a tab that bears contacts;

the tab being formed to be the substantially the same size and shape as a contact bearing blade as specified in the SAS Specification;

the tab having electrical contacts disposed on the first major surface of the same number, and substantially the same size and position as specified for a contact-bearing blade in the SAS Specification;

the tab having electrical contacts disposed on the second major surface of the same number, and substantially the same size and position as specified for a contact-bearing blade in the SAS Specification;

a connector housing;

the connector housing having a front portion and a rear portion;

the rear portion having a pair of laterally-opposed guide arms with guide slots in which the PCB is disposed, the guide slots being internally configured with a set of guide arm steps that correspond to the set of PCB steps;

the housing having a slot through which the tab of the PCB passes and protrudes;

the slot positioned in the housing such that the slot is in line with the guide slots in the guide arms;

the front portion of housing having a protrusion adjacent to the tab slot that is the size and shape of the key for a SAS plug connector in accordance with the SAS Specification;

the combination of the protrusion and the tab create the contact bearing blade of a SAS plug connector in accordance with the SAS Specification;

the front portion having a pair of laterally-opposed differently-sized polygonally-shaped guide arm receiving cavities being integrally formed with the housing and being disposed in line with the signal blade and the power blade the guide arm receiving cavities adapted for mating with a SAS receptacle connector in accordance with the SAS Specification.

* * * * *